US007127840B2

(12) United States Patent
McCabe

(10) Patent No.: US 7,127,840 B2
(45) Date of Patent: Oct. 31, 2006

(54) LAUNDRY ARTICLE SPREADER APPARATUS AND METHOD

(75) Inventor: Stanley G. McCabe, Lubbock, TX (US)

(73) Assignee: FinishTech, Inc., Chicago, IL (US)

( * ) Notice: Subject to any disclaimer, the term of this patent is extended or adjusted under 35 U.S.C. 154(b) by 0 days.

(21) Appl. No.: 10/943,573

(22) Filed: Sep. 17, 2004

(65) Prior Publication Data

US 2005/0028410 A1 Feb. 10, 2005

Related U.S. Application Data

(63) Continuation-in-part of application No. 10/635,866, filed on Aug. 6, 2003, now Pat. No. 6,826,856.

(51) Int. Cl.
*D06F 67/04* (2006.01)
*D69F 69/00* (2006.01)

(52) U.S. Cl. ..... 38/143

(58) Field of Classification Search ..... 38/143, 38/144, 7, 8, 9, 11, 12; 26/87, 88, 97, 98, 26/106; 271/227
See application file for complete search history.

(56) References Cited

U.S. PATENT DOCUMENTS 1,912,724 A * 6/1933 Remington ..... 38/8
3,092,263 A 6/1963 Beaudry et al.
3,092,271 A 6/1963 Beaudry et al.
3,168,307 A 2/1965 Walton et al.
3,421,756 A 1/1969 Weir
3,429,063 A 2/1969 Myers
3,553,863 A 1/1971 Sjostrom
3,696,942 A 10/1972 Kitchener et al.
3,874,043 A * 4/1975 Holm ..... 26/98
3,911,604 A 10/1975 Sjostrom
4,053,967 A 10/1977 Mair
4,106,227 A 8/1978 Allen et al.
4,299,521 A 11/1981 Jensen
RE31,453 E 12/1983 Olsen et al.
4,447,972 A 5/1984 McCabe
4,774,505 A 9/1988 Ueda et al.
4,943,198 A 7/1990 McCabe
4,979,868 A 12/1990 Ueda et al.
5,046,272 A * 9/1991 Vogt et al. ..... 38/143
5,168,645 A 12/1992 Robin et al.
5,169,282 A 12/1992 Ueda et al.
5,172,502 A 12/1992 Kober (Continued)

FOREIGN PATENT DOCUMENTS

GB 2219313 12/1989

*Primary Examiner*—Ismael Izaguirre
(74) *Attorney, Agent, or Firm*—Brinks Hofer Gilson & Lione

(57) ABSTRACT

A towel spreader is provided. A trailing corner is clamped to isolate an edge of a towel where the edge is either along a fold in a towel or along an outer extremity of the towel. The towel is then flattened in a single or two layers using motion and gravity while being held along the identified edge. The same or a different trailing corner is then rotated such that a back outer extremity edge of the towel is perpendicular with a direction of movement of a conveyor. By clamping the back edge while continuing to move a downstream conveyor and blow air on the towel, the towel is flattened out. The spread towel is then passed downstream for further processing, such as folding.

45 Claims, 5 Drawing Sheets

U.S. PATENT DOCUMENTS 5,179,795 A * 1/1993 Nakamura et al. ..... 38/143
5,300,007 A 4/1994 Kober
5,333,402 A 8/1994 Weir
5,416,992 A 5/1995 Ueda et al.
5,440,810 A 8/1995 Borucki et al.
5,515,627 A 5/1996 McCabe
5,546,684 A 8/1996 Jensen
5,595,467 A 1/1997 Jensen
5,611,159 A * 3/1997 Jensen ..... 38/143
6,141,893 A 11/2000 McCabe
6,477,797 B1 11/2002 Takahashi et al.
6,533,267 B1 * 3/2003 Muessig et al. ..... 271/228
6,584,711 B1 7/2003 Nakamura
6,826,856 B1 * 12/2004 McCabe ..... 38/143

* cited by examiner

LAUNDRY ARTICLE SPREADER APPARATUS AND METHOD

REFERENCE TO RELATED APPLICATIONS

The present patent document is a continuation-in-part of application Ser. No. 10/635,866 filed Aug. 6, 2003, now U.S. Pat. No. 6,826,856, the disclosure of which is hereby incorporated by reference.

BACKGROUND

The present invention relates to automated laundry spreaders. In particular, a spreader for laying articles of laundry out flat is provided.

Many processes in laundries are automated. For example, machines in hotels spread out, iron and fold sheets without operator intervention. To begin the automated process, the operator identifies either corners or an edge of the sheet and places the corners or edge into the first machine. Since sheets have large dimensions with thin fabric, the sheets are often tangled together, necessitating either an automated separator machine or an operator for locating the edges or corners.

Since towels are smaller and thicker, towels may be less likely tangled after removal from a washing or drying machine. However in typical towel processing, an operator still grabs individual towels and places them on folding machines. Where possible, automated processes may save money over a period of time.

Machines for automatically grabbing towels from a load of towels and spreading the towels have been attempted, but find little commercial success. Typically, these machines attempt to isolate diagonal corners and then opposite corners. Such isolation can be difficult and inconsistent when implemented with a machine.

BRIEF SUMMARY

The present invention is defined by the following claims, and nothing in this section should be taken as a limitation on those claims. By way of introduction, the preferred embodiments described below include apparatuses and methods for spreading a towel from a load of towels. A trough feeds the picking system. A prong extends into the trough for catching and moving the articles towards a clamping area. Clamped articles are laid on a platform. Once the articles are clamped again, the platform is rotated away from the article of laundry. After laying the article on a conveyor, the article is aligned with a direction of conveyance. The clamp used for aligning includes an air nozzle for attempting to flatten the article during the alignment process. For further attempts at flattening, the article is clamped to a conveyor while a downstream conveyor continues to run. A blower between the two conveyors and another above also attempt to lay out the article in a flat position. A sensor determines whether the article is in a proper position. If not, the conveyor moves in one direction to deposit the article back into the trough. If properly positioned, the conveyor operates in an opposite direction to pass on the article. These processes are performed free of clamping a corner of the article of laundry.

Each of the individual stages described above may be used in a different apparatus or used with or without other stages described above. Any of the overall structure, individual stages or combinations of individual stages in the embodiment below may provide advantages and be claimed independently herein.

In a first aspect, an apparatus is provided for spreading an article of laundry from a load of articles of laundry. A moveable plate connects with a frame. The movable plate is operable to support the article of laundry. A first clamp is operable to drag the article of laundry onto the moveable plate. A sensor is operable to sense the article of laundry on the moveable plate, and the first clamp operable to release the article of laundry on the moveable plate in response to the sensor. A second clamp is operable to grab the article of laundry from the moveable plate. A release is operable to allow movement of the moveable plate in conjunction with the second clamp grabbing the article of laundry on the moveable plate such that the moveable plate moves away from the second clamp.

In a second aspect, a method is provided for spreading an article of laundry from a load of articles of laundry. The article of laundry is positioned on a platform. The article of laundry is clamped while on the platform. The clamped article of laundry is moved in one direction while moving the platform in a different direction.

In a third aspect, an apparatus is provided for preparing for spreading laundry from a load of articles of laundry. A trough is operable to hold a plurality of articles of laundry. The trough has a pick-up location corresponding to the removal of one or more of the articles of laundry from the trough. A prong extends into the trough and is operable to move towards the pick-up location.

In a fourth aspect, a method of preparing is provided for spreading laundry from a load of articles of laundry. A plurality of articles of laundry is positioned in a trough. A prong is moved through the trough. At least one article of laundry is moved towards a pick-up location of the trough in response to movement of the prong.

In a fifth aspect, an apparatus is provided for spreading an article of laundry from a load of articles of laundry. A second conveyor is spaced from a first conveyor by a slot. The slot is narrow such that the article of laundry is able to rest on both the first and second conveyors at a same time. A clamp is positioned to move in the slot between the first and second conveyors. An air nozzle is adjacent the clamp and directed towards the article of laundry.

In a sixth aspect, a method is provided for spreading an article of laundry from a load of articles of laundry. An article of laundry is conveyed on a first conveyor. The article of laundry is conveyed onto a second conveyor. A first edge of the article of laundry is clamped between the first and second conveyors. The clamped first edge of the article of laundry is moved closer to a side of the second conveyor such that a second edge of the article of laundry is more perpendicular to a direction of travel of the second conveyor. The article of laundry is blown with air from a side of the article of laundry.

In a seventh aspect, an apparatus is provided for spreading an article of laundry from a load of articles of laundry. A second conveyor is disposed downstream from a first conveyor. A first blower is above the second conveyor and directed towards the second conveyor. A second blower is operable to blow air between the first and second conveyors. The first and second blowers are operable to direct air towards the article of laundry while the article of laundry is on both the first and second conveyors.

In an eighth aspect, a method is provided for spreading an article of laundry from a load of articles of laundry. The article of laundry is positioned on both first and second conveyors where the second conveyor downstream from the first conveyor. The article of laundry is blown from above the article of laundry and below the article of laundry.

In a ninth aspect, an apparatus is provided for spreading an article of laundry from a load of articles of laundry. A second conveyor is disposed downstream from a first conveyor. A sensor is operable to sense the article of laundry on the second conveyor. The second conveyor is operable to convey the article of laundry in a first direction in response to the sensor indicating a proper position and in a second direction in response to the sensor indicating an improper position.

In a tenth aspect, a method is provided for spreading an article of laundry from a load of articles of laundry. The article of laundry is positioned on both first and second conveyors where the second conveyor downstream from the first conveyor. Whether the article of laundry is properly laid out is sensed. The article of laundry is conveyed in a first direction on the second conveyor if properly laid out and in a second direction if improperly laid out.

Further aspects and advantages of the invention are disclosed below in conjunction with the preferred embodiments.

BRIEF DESCRIPTION OF SEVERAL VIEWS OF THE DRAWINGS

The components and the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

FIGS. 1–7 show various aspects of one embodiment. FIGS. 8–12 show various aspects of other or alternative embodiments for use with the system of FIGS. 1–7. Various stages and aspects of the embodiment may be altered or changed based on now known or later developed devices and methods. The spreader isolates a towel from a load of towels and spreads the towel out flat for subsequent processing. For example, the towel is output to an automated towel folder, such as disclosed in U.S. Pat. No. 5,300,007, the disclosure of which is incorporated herein by reference. Alternatively, the spread towel is output to an operator or stacked for further use.

The towel spreader described herein is adapted for isolating and spreading square hand towels, including napkins. For example, terry cloth hand towel, other hand towels or cotton napkins around 8 to 18 inches on a side are processed. Larger towels or smaller towels may also be processed. In other embodiments, one or more of the stages described herein are used for processing rectangular towels, such as hand, bath and beach towels. Towels with thinner material, such as woven or knit pillowcases, pillow shams or other laundry articles may also be processed. Other articles of laundry, such as sheets or blankets, may also be spread using one, more or all of the stages described herein.

Figure 1:
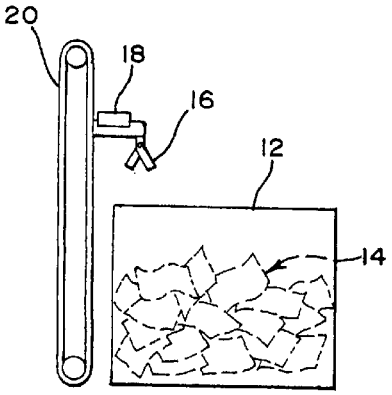
FIG. 1 is a front view of an initial clamp mechanism of a towel spreader in one embodiment.
Figure 2:
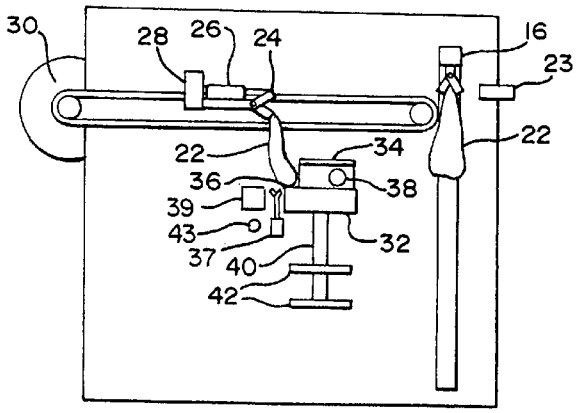
FIG. 2 is a side view of a cutaway portion of the initial stages of a towel spreader in one embodiment.
Figure 4:
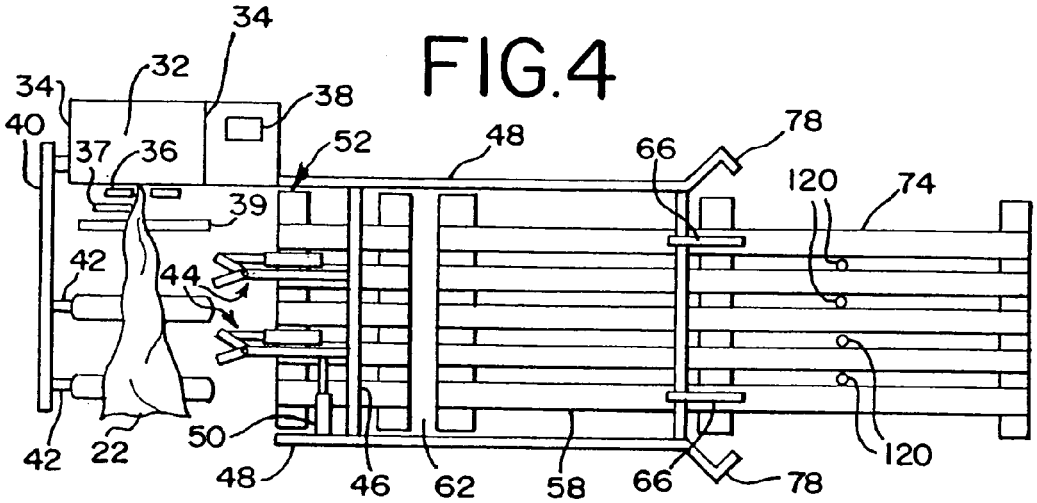
FIG. 4 is a top view of the portion of the towel spreaders shown in FIG. 3.
Figure 3:
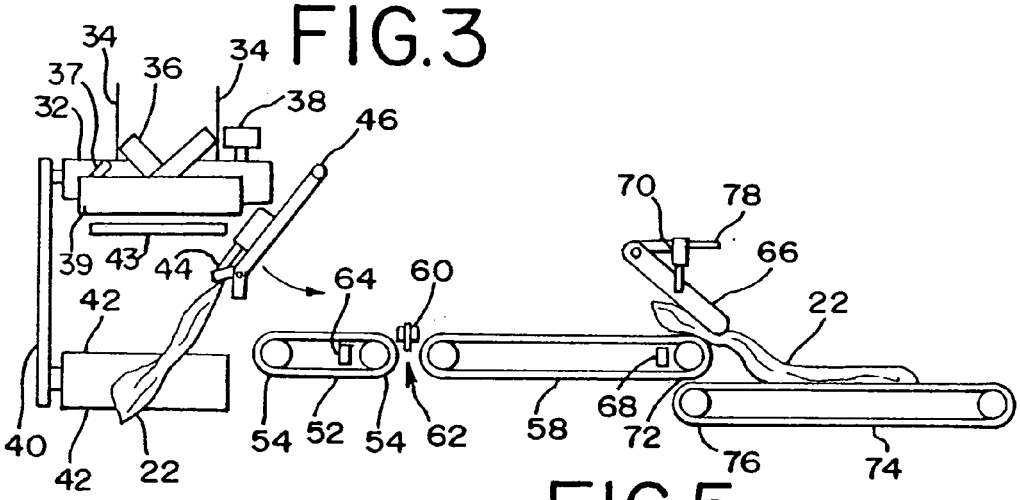
FIG. 3 is a cutaway front view of some of the same and subsequent stages of the towel spreader of FIG. 2.

FIGS. 1–7 show one apparatus positioned within a single frame structure. Different portions of the apparatus are shown in different views to illustrate the components and operation of various stages for spreading a towel. In one embodiment, the stages are built together within the frame work in as small a space as possible while providing sufficient volume for spreading towels. FIG. 2 shows an interior side wall and some related components. In one embodiment, FIG. 2 shows a left interior side wall. FIGS. 3 and 4 show side and top views of components adjacent to and extending away from the interior wall of FIG. 2. Various plates for safety and preventing operators from entanglement within the spreader are included, but not shown. Electrical, hydraulic and air pressure cables and hoses interconnect various components for controlling and operating spreading of the towel. These cables and hoses are configured and routed as is known in the art or later developed. One or more controllers, such as a processor, coordinate the movement and operation of the various components.

FIG. 1 shows a bin 12 for holding a load of towels 14. The bin 12 is of various sizes or shapes. In one embodiment, the bin 12 tapers towards one location at the bottom of the bin 12. As towels are removed from the bin, remaining towels migrate towards the location for clamping. In alternative embodiments, conveyors, vibration, tilting mechanisms or other devices are provided for continually positioning towels near a clamping position. The bin 12 is positioned beneath the system in general such that any towels dropped throughout processing are placed back within the bin 12. Alternatively, the bin 12 is small enough such that dropped towels and other portions of the system will fall into a separate compartment.

Figure 10B:
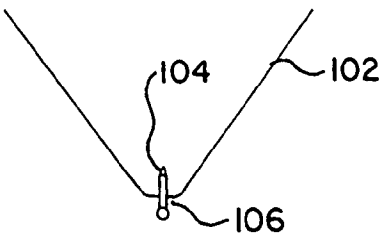
FIGS. 10A and 10B are top and cross-sectional views of one embodiment of a trough for holding a plurality of articles of laundry for separation.
Figure 10A:
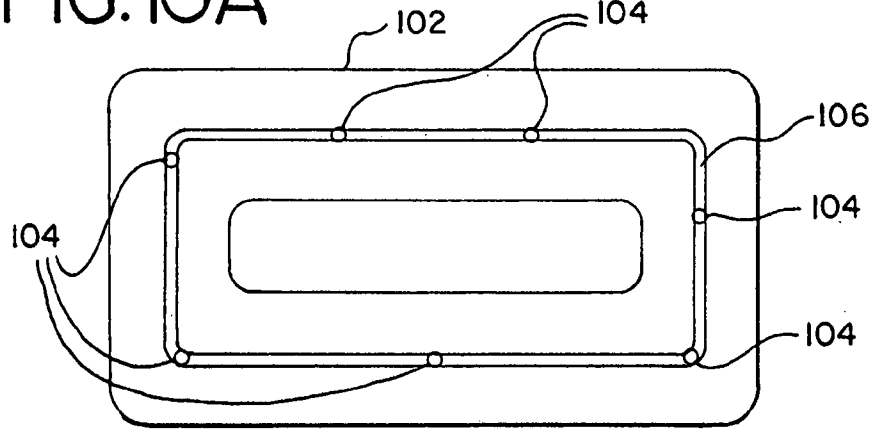

FIGS. 10A and 10B show an alternative embodiment of the bin 12, a trough 102. The trough is metal, wood, fiberglass, plastic or any other now known or later developed material sized and shaped to hold a plurality of articles of laundry. The trough 102 is shaped as an endless loop with or without an open center. A square, rectangular, circular, oblong or other shape may be used for the endless loop. In another embodiment, the trough is linear or curved, but without an endless loop. In cross-section, the trough 102 has a V-shape, but a U or other shapes may be used. The shape acts to dispose or bias articles of laundry towards one or more prongs 104.

The trough 102 is positioned relative to the clamp 16 of FIG. 1. A location of the trough, such as a corner, center of a short side, center of a long side or any other location is a pick-up location for removal of one or more of the articles of laundry from the trough 102.

The prongs 104 are plastic, wood, metal, fiberglass or any other now known or later developed material. The prongs 104 are shaped as cylinders, cubes or other shapes. For example, the prongs 104 have a curved surface or tilt along a forward moving face for disposing articles of laundry towards a base such that the articles of laundry are less likely to slide by or over the prongs 104.

The prongs 104 extend into the trough 102, such as extending from a slot 106 on a bottom of the trough 102. The prongs 104 are connected to a belt, conveyor, chain, cable or other structure for moving the prongs 104 through the slot 106 and trough 102. For example, the prongs 104 are on a cable or belt for moving along the endless loop formed by the trough 102. The prongs 104 are continuously exposed or extend into the trough 102 while circling through the trough 102. Alternatively, the prongs 104 move around a loop structure such that the prongs 102 are exposed in the trough 102 along a portion of the loop and removed from the trough 102 along another portion of the loop. Multiple loops with prongs 104 may be used to provide prongs along the entire endless loop of the trough 102.

By moving the prongs 104 continuously towards the pick-up location, the articles of laundry are moved towards the pick-up location. At least one article of laundry is moved towards a pick-up location of the trough in response to moving the prong 104. The prongs 104 may be guided out of the trough 102 near or at the pick-up location to leave the articles of laundry at the pick-up location. Alternatively, the prongs 104 move a set distance, such as the spacing between adjacent prongs 104, in response to a failure to clamp one or more times by the clamp 16. The next prong 104 moves to the pick-up location in order to bring a next group of articles of laundry for clamping.

The movable clamp 16 is a chuck, scissor clamp, two opposing plates, jaws, pinch roller, pinch plates, pinching belts or other structure operable to hold a towel. In one embodiment, the clamp 16 includes two metal plates separated by a space for one jaw and an opposing metal jaw operable to move between the two plates of the other jaw. The towel is clamped between the two jaws. Plastic, wood or other materials may be used.

The clamp 16 is actuated by a pneumatic cylinder 18. One or both jaws of the clamp 16 connect with the pneumatic cylinder 18 or a plurality of cylinders. In alternative embodiments, an electric servo, an air driven cylinder, hydraulic cylinder, a pneumatic actuator, extending screw device with an electric motor or other mechanism is provided for actuating the clamp.

The clamp 16 and the actuator 18 are connected to a drive structure 20. In one embodiment, the drive structure 20 is a pulley and motor with an endless belt or chain. For example, a timing belt with an inverter is used. The clamp 16 connects to one run of the endless chain to clamp objects in a downward direction. Using an electrical control and sensors, the drive structure 20 is operable to position the clamp 16 adjacent to or in the load of towels 14. The clamp 16 clamps one or more towels. The clamp 16 is sized to most likely select a single towel, such as by having jaws that extend only about an inch. The clamped towel and clamp 16 are moved away from the load of towels 14, such as upwards. FIG. 2 shows the clamp 16 at an upward position with the towel 22 hanging down. Timing on the timing chain of the drive mechanism 20 and/or electric eyes are used to detect that the towel 22 is positioned on the upper location as shown in FIG. 2. For example, the sensor 23 detects the presence of the towel 22 at the uppermost position or a position ready for the next stage of processing.

A horizontally moving clamp 24 and associated actuator 26 with the same or different structures as discussed above for clamp 16 and actuator 18 grabs the towel 22. The clamp 24 is connected to a drive mechanism 30 of the same or different structure as the drive mechanism 20 discussed above. The clamp 24 and actuator 26 connect with the drive mechanism 30 by a plate and bolts or other mechanism 28. In response to the sensor 23, the drive mechanism 30 positions the clamp 24 against the towel 22. Once positioned against the towel 22, the clamp 24 closes to grab the towel 22. In one embodiment, a sensor is provided to detect contact of the clamp 24 with the towel. In other embodiments, the clamp 24 is positioned to where a towel should be positioned. In response to the closing of clamp 24, the clamp 16 releases the towel. The clamp 24 grabs the towel just below the clamp 16 or at another location anywhere on the towel 22.

The drive mechanism 30 moves the clamp 24 and the towel 22 horizontally away from the clamp 16. Movement up or down or in any other direction may be provided. The towel 22 hangs by force of gravity from the clamp 24 until coming in contact with a plate 32. In one embodiment, the plate 32 is a flat metal plate, but a plate with a rough surface, irregular shape or curved surface of any material may be used. Two guides 34 are positioned on each side of the plate 32 so that the towel 22 is dragged between the guides 34 over the plate 32. The plate 32 and guides 34 are sized and positioned to position the towel 22 being dragged by the clamp 24 in the jaws of an additional clamp 36 at the side or end of the plate 32.

The clamp 36 is of a same or different structure as described above for the clamp 16. In one embodiment, the clamp 36 has one jaw movable by pneumatic activation and another jaw made of a couple plates separated by a space sufficient to accept the opposing jaw. In one embodiment for increased clamping speed, both jaws connect with separate actuators (e.g., pneumatic cylinders) for coordinated movement to clamp the towel 22. The clamp 36 is sized and positioned so that as the towel 22 exits off the plate 32, the towel 22 is between the jaws of the clamp 36.

As shown in FIGS. 2–4, a sensor 38, such as a light beam sensor for transmitting a beam of light and receiving any reflection, is positioned to detect the towel 28 through a hole in the guide 34. A hole may be provided in both guides 34 to better distinguish between the presence and absence of the towel 22. As the towel 22 is dragged across the plate 32 and through the open clamp 36, the light sensor 38 detects a trailing or end portion of the towel 22. Since the towel is usually gripped at a position other than the center of the towel by the clamp 24, the trailing portion of the towel 22 is a corner of the towel. Upon sensing the end of the towel, the clamp 36 is activated to close, grabbing the trailing corner of the towel 22. As or after the clamp 36 closes, the clamp 24 is opened. As a result, the towel 22 hangs from a corner from the clamp 36 on a front side of the plate 32.

Figure 8A:
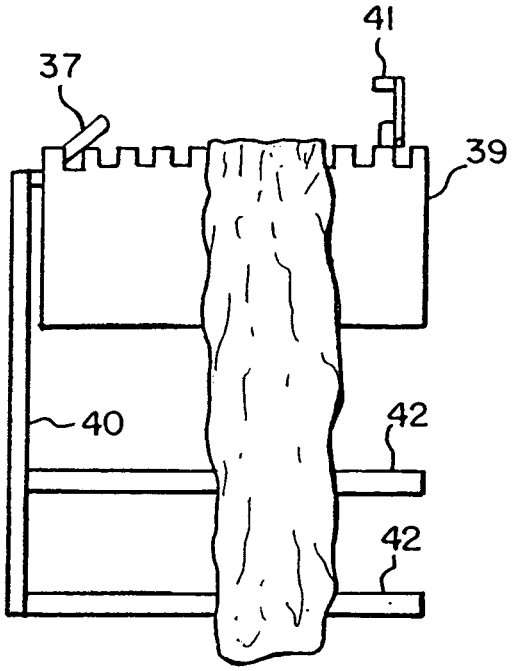
FIGS. 8A and 8B are front views of a spreading clamp structure of one embodiment.
Figure 8B:
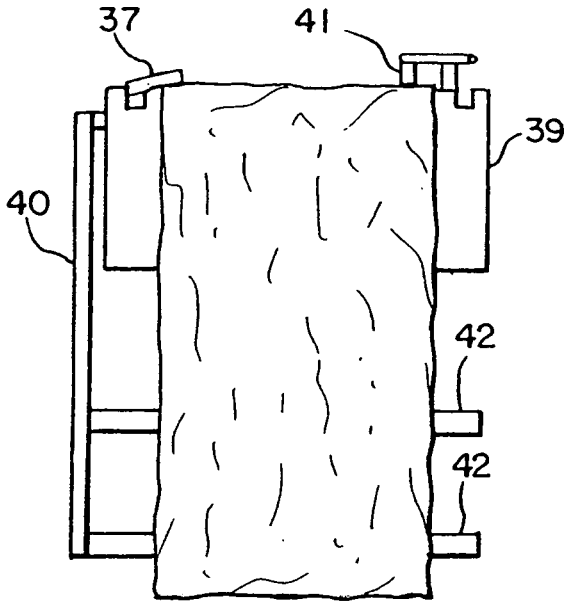
Figure 9:
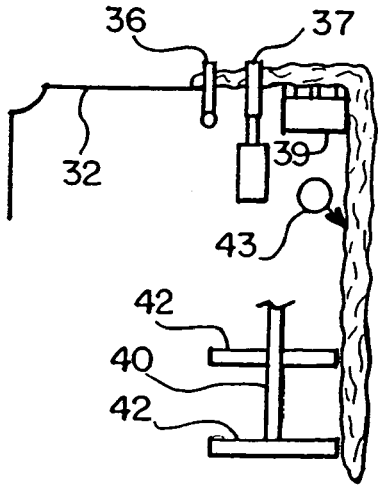
FIG. 9 is a side view of the spreading clamp structure of FIGS. 8A and 8B.

In one embodiment shown in FIGS. 8A, 8B and 9, a further spreader is provided. A belt or plate 39 with a plurality of cleats, a rough surface, bristles, or other tacky surface is positioned beyond the clamp 36. When the clamp 24 is opened, the towel 22 drapes over the plate 39. About 2 to 4 inches of the towel is positioned from the clamp 36 to the plate 39 in a horizontal or other angle from horizontal position. For smaller towels, the plate 39 is positioned more below and/or closer to the clamp 36 to provide more vertical drop. The remainder of the towel 22 hangs from the plate 39 due to gravity. Alternatively, the towel 36 is allowed to hang vertically from the clamp 36 without contacting the plate 39.

An additional clamp 37 of the same or different structures and actuators as discussed for the clamp 16 and actuator 18 is provided between the plate 39 and the clamp 36. The additional clamp 37 slides, such as on a rodless cylinder, or rotates by a rotary actuator to grab the towel 22 adjacent to the clamp 36. For example, the clamp 37 clamps the towel within about 2 inches from the clamp 36 or the corner of the towel 22, but other distances may be used.

At a same time as the clamp 37 moves to and grabs the towel 22, a pressure point 41 is rotated with a small pneumatic cylinder, rotary cylinder or other device to apply pressure to the towel 22 against the plate 39. The pressure point 41 includes a rubber, plastic, rough surface or other material for slightly gripping the towel 22. The force of the pressure point 41 applied to the towel 22 is small, such as by providing a minimal or small amount of air pressure to the pneumatic cylinder. As the clamp 37 pulls the gripped towel horizontally over the plate 39, the cleats of the plate 39 and the pressure point 41 resist but do not prevent the movement of the towel 22, resulting in wrinkles and folds being pulled out. Also as the clamp 37 clamps the towel 22 or pulls the towel 22, the clamp 36 releases the towel 22. As shown in FIG. 8A, the towel originally hangs from the plate 39 in a bunched position. After the clamp 37 drags part of the towel 22 over the plate 39 and beneath the pressure point 41, the towel 22 is more spread out as shown in FIG. 8B. Wrinkles and folds, at least in part, are removed from the towel 22 making the clamps 44 more likely to clamp an outer, actual edge of the towel. While the plate 39 and pressure point 41 are stationary in one embodiment, the plate 39 and pressure point 41 may move in another embodiment. For example, the plate 39 and pressure point 41 are moved in a direction opposite of the clamp 37 to assist in removing wrinkles and folds.

As shown in FIG. 9, an air nozzle or bar 43 with a plurality of holes or nozzles is provided beneath the plate 39. The air bar 43 is connected to a source of pressurized air and directs the air against the towel 22 at a downward angle. The force of the air tends to open folds in the towel 22. The air is directed at the towel 22 during or after the clamping and movement of the clamp 37. In other embodiments, air is applied from other directions, such as by an air bar positioned above the plate 39.

A lift 40 is positioned below the plate 32, clamp 36, plate 39 and clamp 37. The lift 40 includes two plates or bars 42 on one end and an electric motor driven pivot point on another end. Pneumatic, chain, gear, air or other drive mechanisms may be provided. In one embodiment, the plates 42 are perpendicular to an arm of the lift 40. The plates 42 include fibers or bristles for preventing the towel 22 from sliding. In alternative embodiments, metal, rubber or other materials are provided. As an alternative to the plates 42, a single plate extends along the lift 40 or perpendicular to the lift arm may be used. As yet another alternative, a clamp is positioned on the lift 40 with or without plates 42. The clamp grabs the towel and holds the towel while the lift moves the towel into position.

Figure 5:
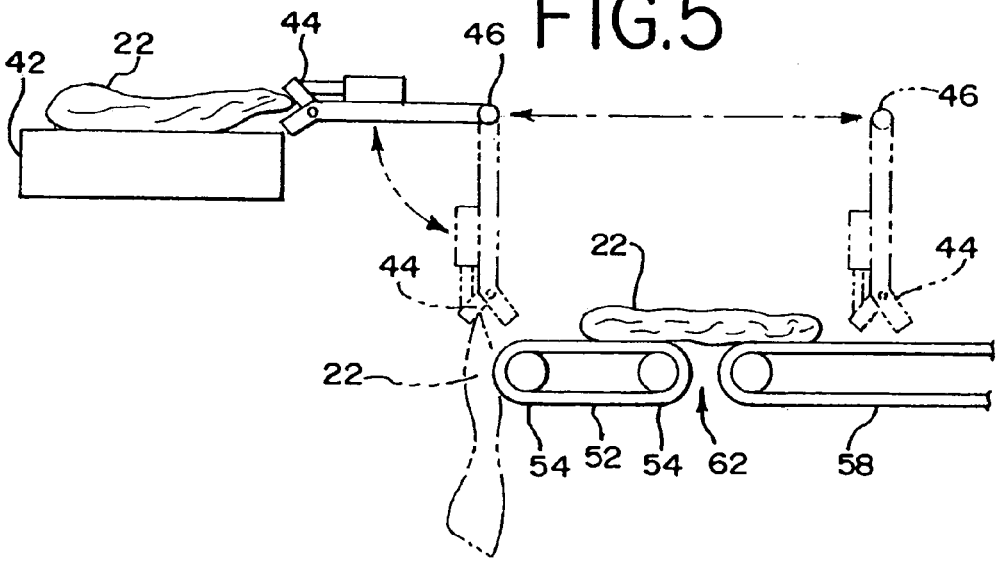
FIG. 5 is a side view of a rotatable and movable clamp shown in FIGS. 3 and 4.

The lift 40 begins in a downward position, such as the vertical position shown in FIGS. 2 and 3. In response to the completed spreading action by the clamp 37, the lift 40 is rotated against the towel 22 to lift the towel 22 to a substantially horizontal position as shown in FIGS. 4 and 5. As shown in FIG. 4, one corner of the towel 22 is held in the clamp 37 and/or draped on the plate 39 and another end or portion of the towel 22 is spaced from the plate 39 or clamp 36. A minor or major portion of the towel 22 may hang down vertically from the end of the lift 40. By lifting the towel 22 from a vertical position hanging down from the plate 39 to a horizontal position, the lift 40 positions the towel 22 adjacent to a pair of clamps 44.

Figure 11B:
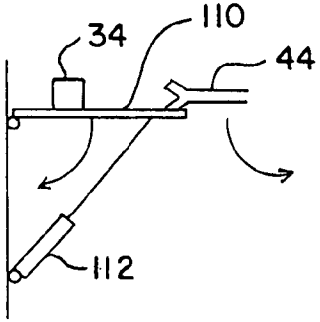
FIGS. 11A and 11B are top and side views of an alternative embodiment of a moveable plate to assist in spreading an article of laundry.
Figure 11A:
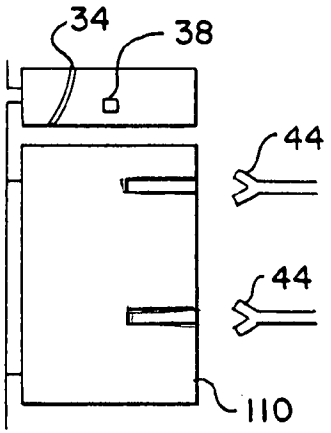

FIGS. 11A and 11B show an alternative embodiment to the clamp 36 and lift 40 of FIG. 3–4 or 8–9. The clamp 24 drags the article of laundry over the guide 34 onto a moveable plate 110. The clamp 24 releases the article of laundry once a trailing or end portion is sensed by the sensor 38. The article of laundry is released without clamping a corner of the article of laundry prior to the release. For example, the clamp 36 of FIGS. 3–4 is not provided. Furthermore, the previous stages prior to positioning on the moveable plate 110 are free of intentionally clamping a corner. The corner may be randomly clamped, but the process is performed without relying on identifying and clamping a corner of the article of laundry. Once released, the article of laundry is positioned on a platform formed by the moveable plate 110.

The moveable plate 110 is a metal, wood, plastic, fiberglass or other material plate. The movable plate 110 is sized to hold at least half of or the entirety of the article of laundry in a spread or bunched position to support the article of laundry. A roughened surface is provided to prevent or reduce the risk of the article of laundry from sliding off of the moveable plate 110. Alternatively, the surface is flat. The moveable plate 110 is square, rectangular, oblong, circular or other shape. In one embodiment, the moveable plane 110 includes one or more slots, such as two slots. The slot or slots extend into a portion of the plate or along an entire length of the plate (e.g., forming two or more separate plates separated by the slot(s)). The clamps 44 move through the slots to clamp the article of laundry laying across the slots. One clamp 44 may move through a slot while another moves along an edge of the moveable plate 110, or both clamps 44 move along different outside edges of the moveable plate 110. Alternatively, the clamps 44 move along the top surface of the moveable plate 110.

The moveable plate 110 is pivotably connected with the frame of the apparatus. One or more hinges allows the moveable plate 110 to rotate from substantially horizontal to substantially non-horizontal. As shown in FIG. 11B, the moveable plate 110 rotates about the hinges downwards towards the frame. Alternatively, the moveable plate 110 rotates to a side or upwards.

A hydraulic or electric actuator 112 acts as a release. The actuator 112 allows gravity to move the moveable plate 110 downwards. Alternatively, the actuator 112 powers or drives the moveable plate 110 downwards. The actuator 112 is also operable to move the plate back to the substantially horizontal position for placing the next article of laundry on the moveable plate 110 by the clamp 24. The moveable plate 110 is released and moved in conjunction with the clamps 44 clamping the article of laundry. The clamps 44 clamp the article of laundry while the moveable plate 110 is in the substantially horizontal position. As the clamps 44 move the clamped article, the moveable plate 110 is released to move away from the clamps 44. The clamped article of laundry is moved in one direction while the platform is moved in a different direction along one dimension.

The clamps 44 are of the same or different structure with the same or different actuators as discussed for the clamp 16 and actuator 18. While two clamps are shown, 1, 3, or other numbers of clamps may be used. Both clamps 44 connect with a rotatable bar or beam 46. The bar 46 is connected at a pivot joint to two runners 48 connected with the frame. The pivot joint includes ball bearings and gearing connected with a drive. In alternative embodiments, the clamps 44 each include separate pivot mechanisms allowing rotation of the clamps 44 about a stationary bar 46.

The drive is an electric motor, belt, pneumatic rotary actuator, air driven cylinder or other now known or later developed device for rotating the clamps 44 and bar 46 about the pivot joint. The pivot point and drive are configured to allow rotation of between 70 and 135 degrees. For example, rotation of 90 degrees from a horizontal to a vertical position is provided. Plates, rubber stoppers, other stoppers, pneumatic cylinders or other devices may be used for limiting the rotation of the clamps 44 about the pivot joint. Alternatively, the operation of the drive is used to limit the rotation of the clamps 44, such as a pneumatic rotary actuator providing about 90 of rotation.

The clamps 44 are positioned against the towel 22 as the towel is in the clamp 36 and rests on the lift 40. For example, the pivot joint and bar 46 are mounted on a rack and pinion along the runners 48. As shown in FIG. 5, the bar 46 and clamps 44 are movable in a horizontal position towards and away from the towel 42 and the lift 40. By rotating the clamps 44 to a horizontal position and moving the clamps 44 towards the towel 22, the clamps contact the towel 22. An electric eye or other detector may be used for determining when the clamps 44 are positioned against the towel 22. Alternatively, the clamps 44 are positioned at a given location under the assumption that the towel 22 is positioned at that location by the lift 40 and clamp 36.

As shown in FIG. 4, one of the clamps 44 is positioned to grab the towel 22 between the two plates 42 of the lift 40. In alternative embodiments, the clamp 44 grabs the towel on the other side of either of the plates 42 or from a notch in a plate. The other clamp 44 grabs the towel between the plates 42 and the clamp 36. In one embodiment, the clamp 44 closest to the clamp 36 (inner clamp 44) is spaced from the clamp 36, such as by a few inches or about ¼ of the length of a typical towel. Alternatively, the clamp 44 is closer to or further from the clamp 36. The clamps 44 clamp random locations on the towel. The random locations correspond to either a true or exterior edge of the towel or an edge formed by the towel being folded over. The towel 22 is clamped by the clamps 44 where both the clamp 44 and the towel 22 are in a substantially horizontal position. Substantially is used herein to account for manufacturing tolerances, drooping of the towel 22, or angles designed to be within 45 degrees of horizontal. Greater angles may be provided in alternative embodiments.

After the clamps 44 grab the towel 22, the lift 40 is rotated back to a position below the plate 32 and clamp 36. The clamp 36 also releases the corner of the towel 22. The clamps 44 and the clamped towel 22 are rotated about the axis of the pivot joint and bar 46. The rotation is downwards as shown in FIG. 5. Since the clamps 44 are spaced from the bar 46, the towel is rotated about an axis spaced away from the towel 22. As a result, gravity and the rotation extend the towel outward in a more flat position as shown in FIGS. 3 and 5. By rotating the lift 40 away from the towel 32, the towel 22 is allowed to extend out flat without interference from other objects as the towel 22 is rotated by the clamps 44. As a result, at least a portion of the towel is forced away from the clamps 44. The rotation and extension flattens out the towel away from the clamps 44. The swinging helps stretch the towel, removing folds and wrinkles other than any fold clamped by the clamps 44.

As shown in FIG. 4, an actuator 50 is connected with the outermost clamp 44. The actuator 50 is a small pneumatic cylinder, air driven cylinder, servo driven or other now known or later developed device for moving the outer clamp 44. Before, during or after rotation of the clamp from the horizontal to the vertical positions, the actuator 50 causes the outward clamp 44 to move away from the inner clamp 44. The towel 22 is stretched between the clamps 44. For grabbing a next towel 22, the actuator 50 positions the outer clamp 44 closer to the inner clamp 44. The outer clamp 44 is connected by hinge to the bar 46 to allow the stretching movement.

In the embodiment shown in FIG. 11, the clamps 44 are operable to grab the article of laundry from the moveable plate 110. The article of laundry is clamped while on the platform in the substantially horizontal position and without intentional or designed clamping a corner of the article of laundry.

A conveyor 52 is positioned below the pivot joint 46. The conveyor 52 is a short conveyor, such as associated with less than half, less than a full or more length of the towel 22. The conveyor 52 includes at least two rollers 54 with one or more belts extending between each roller, such as five straps of fabric, rubber or other material. The conveyor 52 includes a platform beneath the straps in between the rollers 54 in one embodiment, but embodiments may be provided without a platform. The conveyor 52 is driven by a gear, belt or chain connected from a motor to one or both of the pulleys 54. The conveyor 52 is positioned below the pivot joint and bar 46 such that the clamp 44 in the vertical position is above one of the rollers 54. The conveyor 52 may be spaced away from or further underneath the clamps 44. As shown in FIGS. 3 and 5, a portion of the towel 22 extends down below the conveyor 52 and another portion of the towel 22 and the clamps 44 are above the conveyor. In alternative embodiments, the conveyor 52 is long enough such that as the clamps 44 rotate, the towel contacts the top of the conveyor 52 without extending below the conveyor 52.

As shown in FIG. 5, the pivot joint and bar 46 as well as the clamps 44 are moved horizontally over the conveyor 52 in the runners 48. As a result, the towel 22 is dragged and positioned over at least part of the conveyor 52 and at least partly onto a subsequent conveyor 58. The clamp 44 is then opened, releasing the towel 22. Due to the rotation of the clamps 44 as well as the dragging of the towel 22 on the conveyor 52, the towel 22 is released and laid out on the conveyor 52 and/or 58 in a flat position with a minimal number of folds. The conveyor 52 is operated in a forward or reversed direction or held stationary while the towel 22 is dragged by the clamps 44. For example, reverse operation may help flatten the towel. Stationary operation may also assist in flattening the towel. Moving the conveyor forwards such that the upper run of the conveyor proceeds towards the downstream conveyor 58 may prevent the towel 52 from getting snagged.

The downstream conveyor 58 is of a same or different structure than the conveyor 52 discussed above. The downstream conveyor 58 is shown as longer than the conveyor 52, but may be shorter or a same length. The downstream conveyor 58 is spaced from the upstream conveyor 52 by a slot 62. The slot is narrow or has a width such that the towel is able to rest on both the upstream and downstream conveyors 52, 58 at a same time. In one embodiment, the slot 62 is about an inch to 2 inches wide, but may be wider or shorter. Since the clamps 44 release one end of the towel 22 on the conveyor 58, the towel 22 is less likely to fall through the slot. In alternative embodiments, air or other blowers are used with a difference in elevation to allow the towel 22 to convey from the upstream conveyor 52 to the downstream conveyor 58. As shown in the embodiment of FIGS. 3 and 5, the upper surfaces of the upstream conveyor 52 and downstream conveyor 58 are along a substantially same plane, but may be different planes. The conveyors 52 and 58 are aligned to convey the towel 22 in a same direction, such as by shown in the arrows on FIGS. 6 and 7. After the clamps 44 release the towel 22, both conveyors 52 and 58 are activated to convey the towel 22 along an upper surface in the same direction. In alternative embodiments, the conveyor 52 conveys in a different direction, such as a perpendicular or angled direction relative to the conveyor 58.

Figure 6:
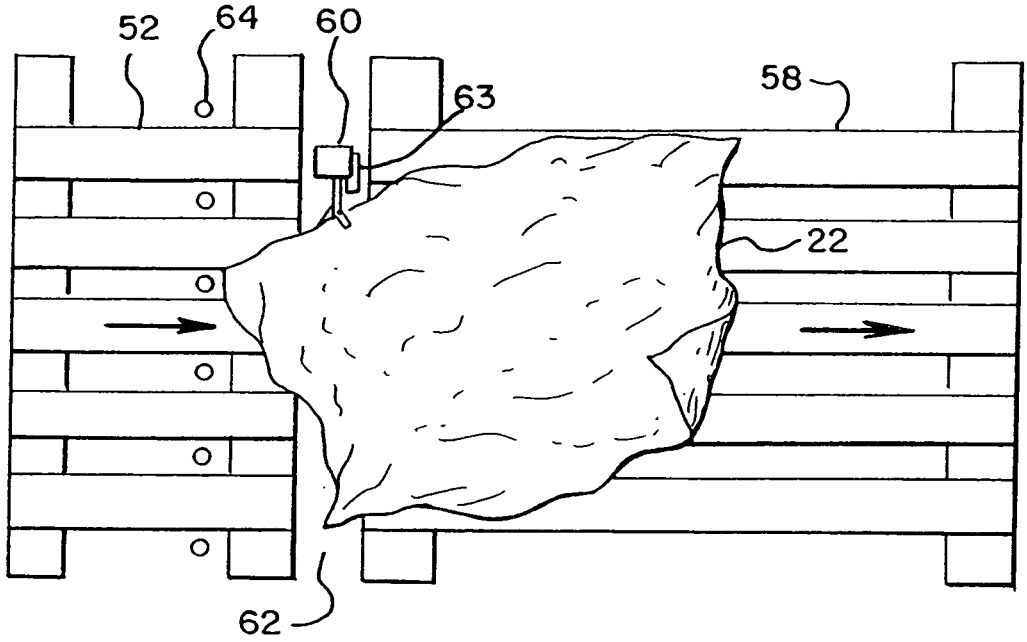
FIG. 6 is a top view of the conveyors shown in FIGS. 3–5 with the towel in a first position.

A sensor 64 is positioned adjacent to the upstream conveyor 52. The sensor 64 is a light sensor, but weight, motion or other now known or later developed sensors may be used. The sensor 64 is positioned to detect a trailing corner of the towel 22 on the upstream conveyor 52. In one embodiment, the sensor 64 is a plurality of light sensors positioned on a platform beneath the straps of the upper run of the conveyor 52 so as to sense a towel 22 between the straps. By providing a sensor array, the trailing corner of the towel 22 is detected as well as a position of the trailing corner perpendicular to the direction of travel of the conveyor 52. In alternative embodiments, the sensors 64 are positioned above the conveyor 52 or are positioned to detect the towel 22 on the conveyor 58 or in the slot 62. When the trailing corner of the towel 22 is detected, such as the last portion of the towel being conveyed off of the last sensor of the array 64 as shown in FIG. 6, the conveyors 52 and 58 are slowed. For example, the conveyors 52 and 58 are stopped. The sensor 64 is spaced from an end of the conveyor 52 such that when the conveyors 52, 58 stop, the towel 22 is positioned on both conveyors. A majority of the towel 22 is positioned on the downstream conveyor 58 while only a trailing corner or a minority of the towel 22 is positioned on the upstream conveyor 52.

A movable clamp 60 is positioned within or adjacent to the slot 62. The clamp is of a same or different structure as the clamp 16 described above. The clamp 60 is connected to a drive mechanism, such as the same or different structure as the drive mechanism 20 described above. The clamp 60 is movable through a part, all or other length of the slot 62. The clamp 60 moves along the plane where the towel 22 is likely to be within the slot 62, such as the plane defined by the upper surfaces of the conveyors 52 and 58.

Figure 7:
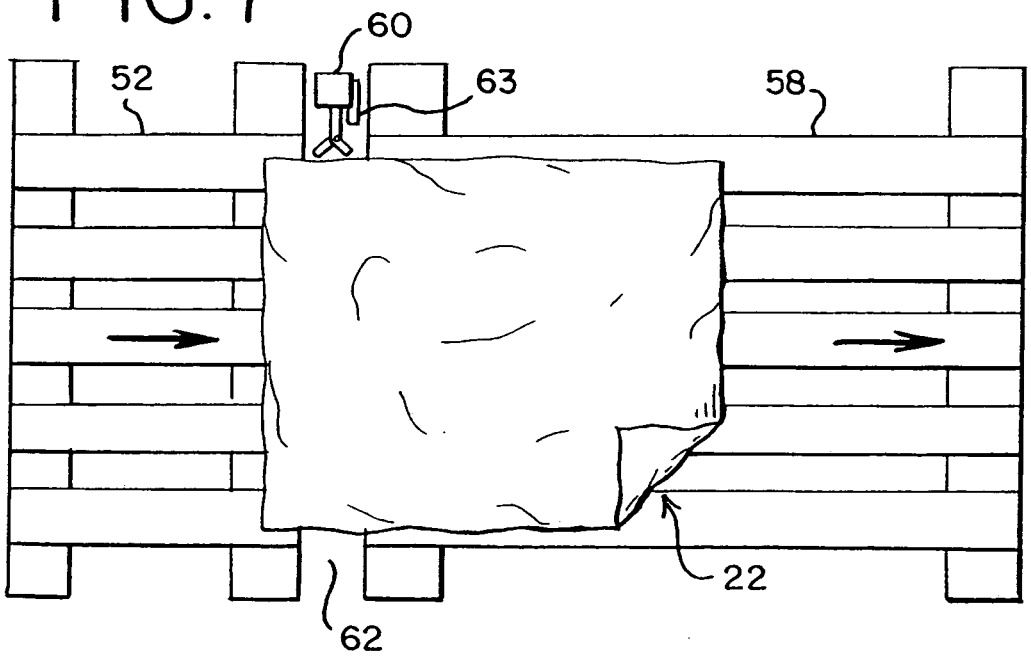
FIG. 7 is a top view of the conveyors of FIG. 6 with the towel in a second position.

The clamp 60 is responsive to the sensor 64. The clamp 64 is moved to a position detected as being the position of the trailing corner by the sensor 64. As a result, the clamp 60 contacts the towel 22. Since the towel 22 is substantially flat, the clamp 60 grabs an edge of the towel 22. After clamping the edge of the towel 22 between the two conveyors 52, 58 as shown in FIG. 6, the clamp 60 moves the clamped edge closer to a side of the upstream and downstream conveyors 52 and 58. As a result of moving the edge of the towel 22 closer to a side of the conveyors, another edge of the towel 22 is more likely squared or made perpendicular to the direction of the travel of the upstream and downstream conveyors 52 and 58. FIG. 7 shows the position of the towel 22 after the clamp 60 moves an edge toward the side, making another edge more perpendicular to the direction of travel of the conveyors 52, 58. As a result, the trailing edge of the towel 22 is now straight or close to straight along a perpendicular direction to the direction of travel of the towel. As shown in FIGS. 6 and 7, one or more folds may occur in the towel 22. Alternatively, the towel is laid out flat without folds.

An air nozzle 63 is positioned adjacent to the clamp 60. The air nozzle 63 is directed towards the article of laundry. In one embodiment, the air nozzle 63 is connected with the clamp 60 such that the air nozzle 63 moves with the clamp 60. Alternatively, the air nozzle 63 is stationary or moves independently of the clamp 60. Once the clamp 60 clamps the article of laundry, the air nozzle blows air at the article of laundry, such as blowing from a side or clamped edge of the article of laundry. By blowing towards the other side of the clamped article of laundry in a fanned or columnar beam of air, the article of laundry is more likely flattened by the air.

Once substantially squared, the towel 22 is conveyed downstream by moving the upper run of the conveyor 58. The conveyor 52 may also be actuated, but may remain in a stationary position in alternative embodiments.

Two or more jaw points 66 (prongs) are positioned above the conveyor 58. The jaw points 66 are plastic, metal, wood, rubber or other now known or later developed materials connected with an actuator 70 in a pivot point. The jaw points 66 act as one end of a clamp. In alternative embodiments, the jaw points 66 comprise a plate or roller that may press against the conveyor 58 in at least the points, such as along a line, to act as a clamp. In alternative embodiments, the jaw points 66 comprise higher clamps operable to clamp the trailing edge or other portion of the towel 22 rather than using the conveyor 58 as one end of the jaw. By actuation of the actuator 70, the jaw points 62 are operable to press against the conveyor 58, pressing and clamping the towel 22 between the jaw points 66 and the conveyor 58. As shown in FIG. 3, the jaw points 66 are oriented such that the clamping position is at a roller 72. In one embodiment, the conveyor 58 includes a plurality of straps and the jaw point 66 are oriented to press against the roller 72 between the straps, such as at a stationary portion of the conveyor 58. A Teflon, plastic or other guard may be positioned around the roller 72 at the press point 66 to avoid friction engagement and wear on the jaw points 66 or roller 72. By providing two or more jaw points 66 spread across the conveyor as shown in FIG. 4, a trailing edge or portion of the towel 22 may be pressed or clamped against the conveyor 58.

A sensor 68 is directed towards the conveyor 58 adjacent to a point or location where the jaw points 66 are operable to contact the conveyor 58. As shown in FIG. 3, the sensor 68 is positioned within the conveyor 58, such as on a platform below the upper run of the conveyor. In alternative embodiments, the sensor 68 is positioned away from the conveyor 58, such as below, above, or to the side of the conveyor 58. While one sensor is shown, an array of sensors may be used. The sensor 68 is a light sensor or other now known or later developed sensor for detecting the presence or absence of the towel 22. In response to the sensor 68 detecting the trailing edge of the towel 22, the conveyor 58 is stopped or continues movement. Alternatively, the conveyor 58 continues to operate. Also in response to the detection of the trailing edge, the jaw points 66 are actuated to press the towel 22 against the conveyor 58, causing the towel 22 to cease forward movement. As a result, conveyance of the towel 22 is stopped. The conveyor 58 is slowed or stopped in response to detection of the trailing edge and during the pressing or clamping of the towel 22 by the jaw points 66. Alternatively, the conveyor 58 is speed up or maintains a same speed. The conveyor 58 may change speed in response to the operation of the clamp 60 in the slot 62 and not in response to the clamping by the jaw points 66. The jaw points 66 operate simultaneously or independently, such as to clamp the article of laundry at different times where the trailing edge is other than perpendicular to the direction of conveyance.

An exit conveyor 74 is disposed downstream from the center conveyor 58. The exit conveyor 74 comprises a same or different structure as the conveyor 52. The exit conveyor 74 is of a similar length to the conveyor 58, but may be longer or shorter. While the term exit is used to describe the conveyor 74, additional or further conveyors may be provided for conveying the towel 22 from the separator. The exit conveyor 74 is positioned downstream from the center conveyor 58 and has a top surface below the top surface of the center conveyor 58. In one embodiment, the top surface of the exit conveyor 54 is below the roller 72. Since the conveyor 58 may be angled downward or upward, and the exit conveyor 74 may also be angled downwards or upwards, the relative positions of the top surfaces described herein is at the roller 72 of the center conveyor 58 and at the roller 76 of the exit conveyor 74 or at the point closest between the center conveyor 58 and the exit conveyor 74. As shown in FIG. 3, the center conveyor 58 overlaps the exit conveyor 74. In alternative embodiments, the exit conveyor 74 is spaced further from or closer to the center conveyor 58 in either horizontal and/or vertical directions. In one embodiment, the exit conveyor 74 conveys the towel 22 in a same direction as the center conveyor 58 so that an end of the center conveyor 58 is adjacent to a beginning of the exit conveyor 74.

As the towel 22 is conveyed off of the center conveyor 58, the towel 22 contacts the exit conveyor 74 and is conveyed away from the center conveyor 58. In one embodiment, the conveyor 74 operates at a slightly faster speed than the conveyor 58 to avoid wrinkling the towel 22. In alternative embodiments, the center conveyor 58 is faster or a same speed as the exit conveyor 74.

The exit conveyor 74 is operable to continue movement while a portion, such as the leading portion or majority of the towel 22 is on the exit conveyor 74 even while the jaw points 66 clamp the trailing edge of the towel 22. By positioning the towel 22 on both the center conveyor 58 and the exit conveyor 74 and clamping the trailing edge of the towel 22, any folds in the towel may be removed. By continuing to convey the exit conveyor 74 while the trailing edge is clamped, any folds in the towel 22 are pulled out by the exit conveyor 74. For example, where a corner of the towel is folded under the majority of the towel 22, the movement of the conveyor 74 while the trailing edge of the towel 22 is clamped forces the folded under corner to extend out flat or unfold.

One or more blowers 78 are positioned to direct air or other gas towards the exit conveyor 74. The blowers 78 are valves or other now known or later developed devices connected with a source of pressurized gas for directing a burst of forced air towards the exit conveyor 74. As shown in FIGS. 3 and 4, two blowers 78 are positioned above and to each side of the exit conveyor 74. The blowers are directed towards the towel 22. In alternative embodiments, the blowers 78 are positioned below the conveyor 74 to direct air through the conveyor 74, are positioned between the center conveyor 58 and the exit conveyor 74, or are positioned to the sides on a same plane with the exit conveyor 74. Other positions and numbers of blowers 78 at one or more of those positions may be used. The blowers 78 direct air towards the towel 22 while the towel 22 is positioned on the exit conveyor 74 and the trailing edge of the towel 22 is clamped by the jaw points 66. By blowing the towel 22 while the trailing edge is clamped, any folds in the towel are flattened out. For example, the forced air assists in flattening out folds underneath the majority of the towel 22. As another example, the blast of air causes folds in the towel above the majority of the towel to flatten out. As a result of the continuing movement of the exit conveyor 74 and the blowing while the trailing edge of the towel 22 is held in position, the towel 22 is more likely laid out flat. In an alternative embodiment, the air is directed at a likely center location of the towel 22 so that as the air contacts the towel and spreads outward from the center point, any folds are extended outward. As a result the towel is laid flat.

Figure 12:
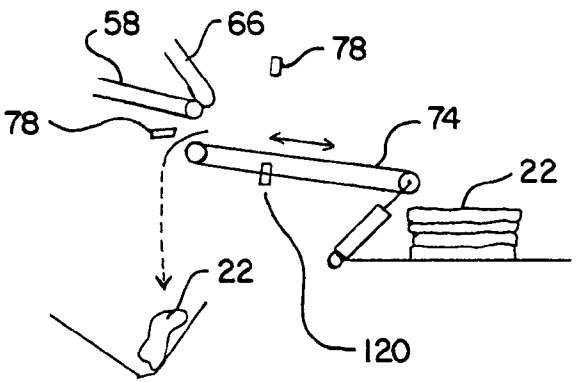
FIG. 12 is a side view of one embodiment of a conveyor arrangement for disposing of articles of laundry.

Other configurations of blowers 78 maybe used, such as shown in FIG. 12. For example, one blower 78 is positioned above and directed towards the conveyor 74. The blower 78 is centered along the conveyor or off-center and is directed straight down or at an angle (e.g. away from the upstream conveyor). Another blower 78 is positioned to blow air between the conveyors 58, 74. The blowers 78 direct air towards the article of laundry while positioned on both conveyors 58, 74, such as when the jaws 66 clamp the article of laundry to the conveyor 58. The blowers 78 operate at a same time or sequentially. By blowing from above and below the article of laundry while the article is clamped to the conveyor 58, the article of laundry is more likely flattened or laid out without wrinkles or folds.

After the blowing is complete, the jaw points 66 are raised, releasing the clamp on the trailing edge of the towel 22. The exit conveyor 74 continues to convey the towel 22 towards an exit of the spreader. As a result, the trailing edge of the towel 22 is conveyed off of the center conveyor 58 and downstream on the exit conveyor 74. At this point, the towel 22 is likely laid out flat and square. For example, two edges of the towel 22 are parallel to the direction of movement and two edges are perpendicular to the direction of movement without any folds in the towel 22. The towel 22 is then provided to an operator or other automated machine, such as an automatic folder.

As shown in FIGS. 4 and 12, a sensor 120 is operable to sense the article of laundry on the exit conveyor 74. The sensor 120 is a plurality of sensors infra red or light sensors operable to detect whether the article of laundry is laid out and in a proper rotation. The sensor 120 is positioned where a leading edge of the article of laundry triggers the sensors while the jaws 66 clamp the article to the conveyor 58. Alternatively, the sensors 120 are positioned to sense the leading edge after the article has been released and conveyed away from the jaws 66. By providing two or more sensors, the edge of the article is sensed. If only one or fewer than all expected sensors given the size of the article are triggered while others are not, then the article of laundry is likely folded or positioned at an angle (i.e., not properly laid out).

The exit conveyor 74 is operable to convey the article of laundry in different directions as shown in FIG. 12 after the jaws 66 release. The article of laundry is conveyed in one direction in response to the sensor 120 indicating a proper position and in an opposite direction in response to the sensor 120 indicating an improper position. For example, an improperly positioned article of laundry is conveyed to fall off of the exit conveyor under the upstream conveyor 58. The bin 12 or trough 102 is positioned below the upstream conveyor 58 and/or the exit conveyor 74 such that the article of laundry falling off of the exit conveyor 74 falls into the trough 102 or bin 12. Alternatively, the article of laundry falls into a different location. A properly positioned article of laundry is conveyed in the opposite direction for further processing by subsequent machines or for stacking. For example, the exit conveyor 74 operates with sufficient speed to place the article of laundry on a pile of articles of laundry in a flat or laid out position. The exit conveyor 74 may be operable to raise or lower to allow for piles of different heights.

While the invention has been disclosed above by reference to various embodiments, it should be understood that many changes and modifications can be made without departing from the scope of the invention. For example, any number of additional stages may be provided. Different clamp, conveyor, sensor, actuator or drive structures may be used, including now known or later developed structures.

It is therefore intended that the foregoing detailed description be understood as an illustration of the presently preferred embodiment of the invention, and not as a definition of the invention. It is only the following claims, including all equivalents, that are intended to define the scope of this invention.

What is claimed is:

1. An apparatus for spreading an article of laundry from a load of articles of laundry, the apparatus comprising:

a frame;

a moveable plate connected with the frame, the movable plate operable to support the article of laundry;

a first clamp operable to drag the article of laundry onto the moveable plate;

a sensor operable to sense the article of laundry on the moveable plate, the first clamp operable to release the article of laundry on the moveable plate in response to the sensor;

a second clamp operable to grab the article of laundry from the moveable plate, the second clamp comprising at least two clamps positioned to grab the article of laundry at two locations, respectively; and a release operable to allow movement of the moveable plate in conjunction with the second clamp grabbing the article of laundry on the moveable plate, the moveable plate moving away from the second clamp.

2. The apparatus of claim 1 wherein the first clamp is operable to drag the article of laundry onto the plate and release the article of laundry without clamping a corner of the article of laundry prior to the release by the first clamp.

3. The apparatus of claim 1 further comprising:

a pivot joint connected with the second clamp and the frame; and a drive connected with the second clamp, the drive connected so as to drive the second clamp downward about the pivot joint;

wherein at least a portion of the article of laundry is forced away from the clamp in response to the clamp being driven.

4. The apparatus of claim 1 further comprising:

a drive operable to move the moveable plate into a position to support the article of laundry in conjunction with the dragging by the first clamp.

5. The apparatus of claim 1 wherein the moveable plate comprises a rotatable plate having a substantially horizontal position and a substantially non-horizontal position, the horizontal position being used to support the article of laundry.

6. An apparatus for spreading an article of laundry from a load of articles of laundry, the apparatus comprising:

a frame;

a moveable plate connected with the frame, the movable plate operable to support the article of laundry;

a first clamp operable to drag the article of laundry onto the moveable plate;

a sensor operable to sense the article of laundry on the moveable plate, the first clamp operable to release the article of laundry on the moveable plate in response to the sensor;

a second clamp operable to grab the article of laundry from the moveable plate; and a release operable to allow movement of the moveable plate in conjunction with the second clamp grabbing the article of laundry on the moveable plate, the moveable plate moving away from the second clamp;

wherein the second clamp is operable to grab at a random location on the article of laundry.

7. A method for spreading an article of laundry from a load of articles of laundry, the method comprising:

(a) positioning the article of laundry on a platform;

(b) clamping the article of laundry while on the platform; and (c) moving the clamped article of laundry in one direction while moving the platform in a different direction, where (c) comprises rotating the clamped article of laundry downward and in the one direction laterally and rotating the platform downward in the different direction laterally.

8. The method of claim 7 wherein (c) comprises:

(c1) rotating the article of laundry about an axis spaced away from the article of laundry, the rotation being at least in part downward; and (c2) flattening the article of laundry in response to the rotation.

9. The method of claim 7 wherein (a) comprises delivering the article of laundry from a group of articles and is performed without clamping a corner of the article of laundry, and wherein (b) is also performed without clamping a corner of the article of laundry.

10. The method of claim 9 further comprising:

(d) releasing the article of laundry after (c) on a surface with the article of laundry in a flat position;

(e) aligning the article of laundry relative to a direction of conveyance without clamping a corner; and (f) flattening the article of laundry with friction, air or combinations thereof.

11. The method of claim 7 wherein (b) comprises clamping the article of laundry while in a substantially horizontal position.

12. An apparatus for preparing for spreading laundry from a load of articles of laundry, the apparatus comprising:

a trough operable to hold a plurality of articles of laundry, the trough having a pick-up location corresponding to the removal of one or more of the articles of laundry from the trough and the trough extending away from the pick-up location to another location spaced from the pick-up location; and a prong extending into the trough, the prong operable to move within the trough from the other location spaced from the pick-up location towards the pick-up location.

13. The apparatus of claim 12 wherein the trough has a V-shaped cross section, the prong extending from a bottom of the trough.

14. The apparatus of claim 12 further comprising additional prongs, the prong and the additional prongs spaced along a loop, at least some of the additional prongs extending into the trough at a given time.

15. The apparatus of claim 12 wherein the trough forms an endless loop, the prong comprising additional prongs operable to move through the endless loop of the trough.

16. A method of preparing for spreading laundry from a load of articles of laundry, the method comprising:

(a) positioning a plurality of articles of laundry in a trough;

(b) moving a prong through the trough; and (c) moving at least one article of laundry towards a pick-up location of the trough in response to (b).

17. The method of claim 16 further comprising:

(d) biasing the articles of laundry towards a bottom of the trough where the prong is positioned at the bottom.

18. The method of claim 16 wherein (b) comprises moving additional prongs, the prong and the additional prongs spaced along a loop, at least some of the additional prongs extending into the trough at a given time.

19. The method of claim 16 wherein (b) comprises moving the prong in an endless loop through a majority of the trough.

20. An apparatus for spreading an article of laundry from a load of articles of laundry, the apparatus comprising:

a first conveyor;

a second conveyor spaced from the first conveyor by a slot, the slot narrow such that the article of laundry is able to rest on both the first and second conveyors at a same time;

a clamp positioned to move in the slot between the first and second conveyors and operable to clamp an article of laundry resting on the first and second conveyors at a same time; and an air nozzle adjacent the clamp and directed towards the article of laundry.

21. The apparatus of claim 20 further comprising a sensor adjacent the first conveyor, the sensor positioned to detect a trailing corner of the article of laundry on the first conveyor, the clamp responsive to the sensor, wherein the first conveyor is operable to cease conveying in response to the sensor such that the trailing corner is on the first conveyor and at least another portion of the article of laundry is on the second conveyor;

wherein the clamp is operable to grab a first edge of the article of laundry and move the edge closer to one side of the second conveyor.

22. The apparatus of claim 20 wherein the clamp is operable to move within the slot, the air nozzle operable to move with the clamp.

23. A method for spreading an article of laundry from a load of articles of laundry, the method comprising:

(a) conveying an article of laundry on a first conveyor;

(b) conveying the article of laundry onto a second conveyor;

(c) clamping a first edge of the article of laundry between the first and second conveyors;

(d) moving the clamped first edge of the article of laundry closer to a side of the second conveyor such that a second edge of the article of laundry is more perpendicular to a direction of travel of the second conveyor; and (e) blowing the article of laundry with air from a side of the article of laundry.

24. The method of claim 23 wherein (e) comprises blowing from the first edge towards an opposite edge.

25. An apparatus for spreading an article of laundry from a load of articles of laundry, the apparatus comprising:

a first conveyor;

a second conveyor disposed downstream from the first conveyor;

a first blower above the second conveyor and directed towards the second conveyor;

a second blower operable to blow air between the first and second conveyors;

wherein the first and second blowers are operable to direct air towards the article of laundry while the article of laundry is on top of both the first and second conveyors.

26. The apparatus of claim 25 wherein the first and second blowers are operable to direct the air at substantially a same time.

27. The apparatus of claim 25 further comprising:

at least one prong positioned above the first conveyor and operable to press a first portion of the article of laundry against the first conveyor;

wherein the second conveyor is operable to continue movement with a second portion of the article of laundry on the second conveyor and while a first portion of the article of laundry is held by the at least one prong against the first conveyor.

28. The apparatus of claim 25 wherein the first conveyor and second conveyor convey in a same direction, the second conveyor having a second top surface lower than a first top surface of the first conveyor, the first top surface at an end of the first conveyor and the second top surface at a beginning of the second conveyor.

29. A method for spreading an article of laundry from a load of articles of laundry, the method comprising:

(a) positioning the article of laundry on top of both first and second conveyors, the second conveyor downstream from the first conveyor;

(b) blowing at the article of laundry during (a) from above the article of laundry and below the article of laundry.

30. The method of claim 29 further comprising:

(c) clamping the article of laundry with a first portion of the article of laundry on the first conveyor; and (d) continuing to convey with the second conveyor while the article of laundry is clamped;

wherein (b) is performed during while (c) and (d) occur.

31. The method of claim 29 wherein (b) comprises blowing air between the first and second conveyors where an end of the first conveyor is above a beginning of the second conveyor.

32. An apparatus for spreading an article of laundry from a load of articles of laundry, the apparatus comprising:

a first conveyor;

a second conveyor disposed downstream from the first conveyor; and a sensor operable to sense the article of laundry on the second conveyor;

wherein the second conveyor is operable to convey the article of laundry in a first direction in response to the sensor indicating a proper position and in a second direction in response to the sensor indicating an improper position.

33. The apparatus of claim 32 further comprising:

at least one prong positioned above the first conveyor and operable to press a first portion of the article of laundry against the first conveyor; and a blower operable to direct air towards the article of laundry while on both the first and second conveyors;

wherein the second conveyor is operable to continue movement with a second portion of the article of laundry on the second conveyor and while a first portion of the article of laundry is held by the at least one prong against the first conveyor.

34. The apparatus of claim 32 wherein the second conveyor has a second top surface lower than a first top surface of the first conveyor, the first top surface at an end of the first conveyor and the second top surface at a beginning of the second conveyor.

35. The apparatus of claim 32 wherein the first direction is towards the first conveyor such that the article of laundry falls off the second conveyor and under the first conveyor.

36. The apparatus of claim 35 further comprising:

a trough operable to hold a plurality of articles of laundry, the article of laundry being picked from the trough prior to being placed on the first conveyor;

wherein the trough is below the first conveyor such that the article of laundry falling off of the second conveyor falls into the trough.

37. The apparatus of claim 32 wherein the sensor comprises a plurality of sensors operable to detect whether the article of laundry is laid out and in a proper rotation at a portion of the article of laundry on the second conveyor.

38. A method for spreading an article of laundry from a load of articles of laundry, the method comprising:

(a) positioning the article of laundry on both first and second conveyors, the second conveyor downstream from the first conveyor;

(b) sensing whether the article of laundry is properly laid out; and (c) conveying the article of laundry in a first direction on the second conveyor if properly laid out and in a second direction if improperly laid out.

39. The method of claim 38 further comprising:

(d) clamping the article of laundry with a first portion of the article of laundry on the first conveyor;

(e) continuing to convey with the second conveyor while the article of laundry is clamped and partially on the second conveyor;

(f) directing air towards the article of laundry during (d);

wherein (c) is performed after (d), (e) and (f) occur.

40. The method of claim 38 wherein the second conveyor has a second top surface lower than a first top surface of the first conveyor, the first top surface at an end of the first conveyor and the second top surface at a beginning of the second conveyor;

wherein (c) comprises conveying the article of laundry towards the first conveyor such that the article of laundry falls off the second conveyor and under the first conveyor if improperly laid out.

41. The method of claim 40 further comprising:

(d) catching the article of laundry in a trough if conveyed in the second direction.

42. The method of claim 38 wherein (b) comprises sensing a leading portion of the article of laundry on the second conveyor.

43. An apparatus for spreading an article of laundry from a load of articles of laundry, the apparatus comprising:

a trough operable to hold a plurality of articles of laundry including the article of laundry, the trough having a pick-up location corresponding to the removal of the article of laundry from the trough;

a prong extending into the trough, the prong operable to move towards the pick-up location;

a first clamp operable to clamp the article of laundry at the pick-up location;

a moveable plate operable to support the article of laundry;

a second clamp operable to clamp the article of laundry while clamped by the first clamp and operable to drag the article of laundry onto the moveable plate;

a first sensor operable to sense the article of laundry on the moveable plate, the second clamp operable to release the article of laundry on the moveable plate in response to the sensor;

a third clamp operable to grab the article of laundry from the moveable plate;

a release operable to allow movement of the moveable plate in conjunction with the third clamp grabbing the article of laundry on the moveable plate, the moveable plate moving away from the third clamp;

a first conveyor positioned to receive the article of laundry from the third clamp;

a second conveyor disposed downstream from the first conveyor and spaced from the first conveyor by a slot, the slot narrow such that the article of laundry is able to rest on both the first and second conveyors at a same time;

a fourth clamp positioned to move in the slot between the first and second conveyors; and an air nozzle adjacent the fourth clamp and directed towards the article of laundry;

a third conveyor disposed downstream of the second conveyor;

a first blower above the third conveyor and directed towards the third conveyor;

a second blower operable to blow air between the second and third conveyors;

wherein the first and second blowers are operable to direct air towards the article of laundry while the article of laundry is on both the second and third conveyors; and a second sensor operable to sense the article of laundry on the third conveyor;

wherein the third conveyor is operable to convey the article of laundry in a first direction in response to the second sensor indicating a proper position and in a second direction in response to the second sensor indicating an improper position.

44. A method for spreading an article of laundry from a load of articles of laundry, the method comprising:

(a) positioning a plurality of articles of laundry in a trough;

(b) moving a prong through the trough;

(c) moving at least one article of laundry towards a pick-up location of the trough in response to (b);

(d) moving the article of laundry from the pick-up location onto a platform;

(e) clamping the article of laundry while on the platform;

(f) moving the clamped article of laundry in one direction while moving the platform in a different direction;

(g) conveying the article of laundry on a first conveyor after (f);

(h) conveying the article of laundry onto a second conveyor;

(i) clamping a first edge of the article of laundry between the first and second conveyors;

(j) moving the clamped first edge of the article of laundry closer to a side of the second conveyor such that a second edge of the article of laundry is more perpendicular to a direction of travel of the second conveyor;

(k) blowing the article of laundry with air from a side of the article of laundry in conjunction with (j);

(l) positioning the article of laundry on both the second and a third conveyors, the third conveyor downstream from the second conveyor;

(m) blowing at the article of laundry during (a) from above the article of laundry and below the article of laundry;

(n) sensing whether the article of laundry is properly laid out after (m); and (o) conveying the article of laundry in a first direction on the third conveyor if properly laid out and in a second direction if improperly laid out.

45. A method for spreading an article of laundry from a load of articles of laundry, the method comprising:

(a) picking the article of laundry from a pile of articles;

(b) transferring the article of laundry to a conveyor;

(c) aligning the article of laundry relative to a direction of conveyance of the conveyor;

(d) clamping a trailing portion of the article of laundry;

(e) directing air toward the article of laundry; and (f) presenting the article of laundry laid out flat; wherein (a)–(f) are performed free of clamping a corner of the article of laundry.

* * * * *